US007256164B2

(12) United States Patent
Otterson et al.

(10) Patent No.: US 7,256,164 B2
(45) Date of Patent: Aug. 14, 2007

(54) HIGH CONCENTRATION SURFACTANT COMPOSITIONS AND METHODS

(75) Inventors: Richard John Otterson, Frankfort, IL (US); Kenneth Raymond Berg, Crown Point, IN (US); Eugene A. D'Aversa, Blue Island, IL (US)

(73) Assignee: McIntyre Group, Ltd., University Park, IL (US)

( * ) Notice: Subject to any disclaimer, the term of this patent is extended or adjusted under 35 U.S.C. 154(b) by 351 days.

(21) Appl. No.: 10/491,384

(22) PCT Filed: Aug. 13, 2003

(86) PCT No.: PCT/US03/25225

§ 371 (c)(1),
(2), (4) Date: Mar. 31, 2004

(87) PCT Pub. No.: WO2004/015047

PCT Pub. Date: Feb. 19, 2004

(65) Prior Publication Data

US 2005/0037942 A1 Feb. 17, 2005

Related U.S. Application Data

(60) Provisional application No. 60/403,012, filed on Aug. 13, 2002.

(51) Int. Cl.

| | |
|---|---|
| ***C11D 1/02*** | (2006.01) |
| ***C11D 1/90*** | (2006.01) |
| ***C11D 1/94*** | (2006.01) |
| ***C11D 3/26*** | (2006.01) |

(52) U.S. Cl. ..... 510/123; 510/125; 510/127; 510/130; 510/137; 510/138; 510/158; 510/426; 510/427; 510/433; 510/499; 510/477; 510/490

(58) Field of Classification Search ..... None
See application file for complete search history.

(56) References Cited

U.S. PATENT DOCUMENTS

| | | | | |
|---|---|---|---|---|
| 2,761,874 | A | 9/1956 | Bersworth et al. | |
| 3,158,635 | A | 11/1964 | Kezerian et al. | |
| 3,915,903 | A | 10/1975 | Wise | |
| 3,954,858 | A | 5/1976 | Lamberti et al. | |
| 4,704,233 | A | 11/1987 | Hartman et al. | |
| 5,554,791 | A | 9/1996 | Lin et al. | |
| 5,652,085 | A | 7/1997 | Wilson et al. | |
| 5,965,505 | A * | 10/1999 | Baillely et al. | 510/311 |
| 6,096,097 | A | 8/2000 | Kummeler et al. | |
| 6,207,629 | B1 | 3/2001 | Gonzalez et al. | |
| 6,316,400 | B1 | 11/2001 | Del Duca et al. | |
| 6,683,033 | B2 | 1/2004 | Gonzalez et al. | |

FOREIGN PATENT DOCUMENTS

| | | |
|---|---|---|
| DE | 44 08 183 | 8/1995 |
| DE | 101 00 720 A1 | 7/2002 |
| EP | 0 591 934 B1 | 1/2001 |
| WO | WO 01/10993 A1 | 2/2001 |

* cited by examiner

*Primary Examiner*—Gregory R. Del Cotto
(74) *Attorney, Agent, or Firm*—Olson & Hierl, Ltd.

(57) ABSTRACT

A high concentration, aqueous liquid surfactant composition is disclosed, comprising at least one amphoteric or anionic surfactant and a liquid-stabilizing amount of at least one liquid-stabilizing agent. The liquid-stabilizing agent is a succinic acid derivative, glutaric acid derivative or a combination thereof. The composition is pourable and pumpable at ambient room temperature.

8 Claims, No Drawings

HIGH CONCENTRATION SURFACTANT COMPOSITIONS AND METHODS

CROSS-REFERENCE TO RELATED APPLICATION

This application is a 371 of PCT/US2003/025225, filed Aug. 13, 2003, which claims the benefit of U.S. Ser. No. 60/403,012, filed on Aug. 13, 2002, which is incorporated herein by reference.

TECHNICAL FIELD OF THE INVENTION

This invention relates to the field of surfactants, and, in particular, to stable, flowable, pumpable, high concentration, aqueous surfactant compositions and methods of producing the same.

BACKGROUND OF THE INVENTION

High concentration, aqueous surfactant solutions are often desired or required for incorporation into a formulation or for conserving storage space or for economical transportation costs. In particular, aqueous liquid amphoteric and liquid anionic surfactant compositions having a total solids content greater than about 25%, preferably greater than about 35%, are desired, which can remain free-flowing and pumpable liquids at ambient room temperature.

One well known problem is that aqueous surfactant solutions, especially amphoteric and anionic surfactants, tend to be non-liquid, that is they either gel or become non-flowable and too viscous to pump at ambient room temperature, when the total solids content exceeds about 35%. Some prior attempts have been made to overcome this problem by adding fluidizers to the reaction mixture, for example, either during or after formation of the surfactant in an aqueous medium, or by introducing special additives or solvents. While some measure of success has been achieved, uneconomically large amounts of special additives, such as polyols and nonionic surfactants, may be required, and some fluidizers, such as solvents, are difficult or costly to remove from the medium. Some fluidizers may also introduce reaction byproducts and components that can interact with other ingredients in the formulation or interfere with the purpose for which the surfactant is subsequently used. Additionally, some fluidizers may introduce unwanted, toxicologically, physiologically, or environmentally unacceptable material.

In recent years, amphoteric surfactants, and in particular, betaine surfactants, have become increasingly desirable as ingredients in personal care products, such as cosmetics, toiletries, cosmeceuticals, topical pharmaceuticals, and the like, especially in products for cleansing the hair and skin. Consequently, there is an ongoing need for high concentration, aqueous surfactant compositions that remain flowable, pumpable liquids at ambient room temperature and contain minimal or no extraneous material from the reaction process. It has been surprisingly found that such a stable, flowable, pumpable, high concentration, aqueous, liquid surfactant composition can be prepared by the method disclosed herein.

SUMMARY OF THE INVENTION

A stable, pourable, pumpable, high concentration, aqueous, liquid surfactant composition is provided which comprises at least one surfactant that is a member of the group consisting of amphoteric surfactants and anionic surfactants, and at least one liquid-stabilizing agent. The liquid-stabilizing agent is a succinic acid derivative, or glutaric acid derivative, each having an α-substituent that can be a sulfonic acid group, a phosphonic acid group, an acidic alkyl group, an alkoxy group, a substituted alkoxy group, an alkylthio ether, a substituted alkylthio ether, a secondary or tertiary amino group, a substituted secondary or tertiary amino group, an alkenyl group, or an alkylamido group. Alternatively, the liquid stabilizing agent can comprise succinic and/or glutaric acid groups linked together by an amino or a polyamino linking group.

One preferred method embodiment for preparing a stable, pourable, pumpable, high concentration, liquid surfactant composition includes the steps of preparing an aqueous surfactant composition at an elevated temperature and adding thereto a liquid-stabilizing amount of at least one liquid-stabilizing agent or a salt thereof; and then cooling the resulting high concentration, liquid surfactant composition to ambient room temperature. A liquid-stabilizing amount of the liquid-stabilizing agent is a quantity sufficient to maintain the high concentration, aqueous surfactant composition in a pourable, pumpable, liquid state at an ambient room temperature of at least about 20° C.

Stable, pourable, pumpable, high concentration, liquid surfactant compositions can be prepared by including a liquid-stabilizing amount of at least one liquid-stabilizing agent in the aqueous reaction medium before, during, or after the formation of the surfactant.

A preferred liquid surfactant composition comprises an amphoteric surfactant, and in particular, a betaine surfactant. A preferred betaine surfactant can be prepared by quaternizing a fatty amine or fatty amidoamine with a ω-haloalkylcarboxylic acid, or a salt thereof, in an aqueous medium having a basic pH, and then adding a liquid-stabilizing amount of liquid-stabilizing agent. Alternatively, the liquid-stabilizing agent can be present in the aqueous medium during the quaternization reaction.

The high concentration liquid surfactant compositions of the present invention preferably contains a total solids content of at least about 30% by weight. The high concentration liquid surfactant compositions preferably contain an amount of liquid-stabilizing agent in the range of about 1 to about 10% by weight based on total composition weight.

In a preferred high concentration liquid anionic surfactant composition embodiment, the anionic surfactant is selected from the group consisting of an alkyl sulfonate, especially a $C_{12-16}$ alpha olefin sulfonate (AOS), an alkyl sulfate, an alkyl ether sulfate, an alkylaryl sulfonate, an alkyl sulfosuccinate, a combination thereof and salts thereof. Particularly preferred anionic surfactants are an AOS, such as sodium $C_{14-16}$ olefin sulfonate; an alkyl sulfate, such as sodium coco-sulfate and sodium lauryl sulfate; and an alkyl ether sulfonate, such as sodium laureth sulfate. Preferred liquid stabilizing agents for high concentration liquid anionic surfactant compositions of the invention are $C_4$-$C_{22}$ alkenylsuccinic acids and salts thereof, such as octenyl succinic acid.

Optionally, the high concentration liquid surfactant compositions can contain salts, including alkali metal halide salts, such as sodium chloride; additional surfactants, such as nonionic surfactants; and other common cosmetic adjuvants.

The high concentration, aqueous liquid surfactant compositions are particularly suitable for cold process manufacturing of consumer products, such as personal care and health care products, and institutional products, and for industrial products and industrial applications.

DESCRIPTION OF THE PREFERRED EMBODIMENTS

The terms "liquid surfactant" and "aqueous, liquid surfactant" are used interchangeably to refer to surfactant compositions comprising water in the medium.

The term "high concentration liquid surfactant composition" and grammatical variations thereof, as used herein, includes aqueous solutions, dispersions, and emulsions of surfactants selected from an amphoteric surfactant, an anionic surfactant, and a combination thereof. The high concentration liquid, and a surfactant compositions contain a liquid stabilizing amount of at least one liquid-stabilizing agent, such that the surfactant composition has a total solids content of at least about 30% by weight and remains a flowable, pourable and pumpable liquid at an ambient room temperature of at least about 20° C. The term "non-liquid" as applied to surfactant compositions refers to compositions having a total solids content of about 30% or more that are substantially non-flowable, non-pumpable, viscous or gelled at ambient room temperature (i.e., Brookfield viscosity of about 5,000 milliPascal seconds (mPa·s) or greater).

The term "stable" as applied to a high concentration, aqueous, liquid surfactant composition means that the composition remains flowable, pourable and pumpable at an ambient-room temperature of at least about 20° C.

The term "liquid-stabilizing agent" as used herein includes acid and salt forms, wherein the liquid-stabilizing agent is a succinic or glutaric acid derivative which has an α-substituent that can be a sulfonic acid group, a phosphonic acid group, an acidic alkyl group, an alkoxy group, a substituted alkoxy group, an alkylthio ether, a substituted alkylthio ether, a secondary or tertiary amino group, a substituted secondary or tertiary amino group, an alkenyl group, or an alkylamido group. Alternatively, the liquid-stabilizing agent can comprises two succinic and/or glutaric acid moiesties joined together by an amino or a polyamino linking group. The salt forms include alkali metal cation salts (e.g. potassium or sodium salts) and ammonium or amine salts.

As used herein, and in the appended claims, the term "amphoteric surfactant", and grammatical variations thereof, refers to surfactants that have both acidic and basic character. In particular, the term refers to surfactants that contain an acidic group and a basic nitrogen-containing group, as described in detail in *Amphoteric Surfactants*, Second Edition, E. G. Lomax (Ed.) Marcel Dekker, Inc., New York (1996), the relevant disclosures of which are incorporated herein by reference (hereinafter "Lomax"). The basic nitrogen-containing group can be either weakly basic or strongly basic. Weakly basic nitrogen-containing groups include primary, secondary and tertiary amino groups, which can be either neutral or cationic, depending on the pH of the medium in which the surfactant is present. Strongly basic nitrogen-containing groups include quaternary ammonium groups, which are cationic at all pH values. Amphoteric surfactants include zwitterionic surfactants such as betaines. As used herein and in the appended claims, the term "betaine" and grammatical variations thereof includes alkyl betaines, alkylamido betaines, sulfobetaines, sulfito betaines, sulfato betaines, phosphinate betaines, phosphonate betaines, phosphito betaines, phosphato betaines, sulfonium betaines, and phosphenium betaines.

The acidic groups of the amphoteric surfactants, as defined herein include carboxylic acids, sulfonic acids, phosphonic acids, and like acid groups.

Amphoteric surfactant compositions of the present invention can include, without limitation, amino acid amphoterics, such as amino carboxylic acids and amino sulfonic acids as described in detail in Chapter 2 of Lomax; betaines, such as alkyl betaines, alkylamido betaines, sulfobetaines, sulfito betaines, sulfato betaines, phosphinate betaines, phosphonate betaines, phosphito betaines, phosphato betaines, sulfonium betaines, phosphenium betaines, and the like, as described in detail in Chapter 3 of Lomax; imidazoline derived amphoterics, such as described in detail in Chapter 4 of Lomax; and alkyl polyamino amphoterics, such as fatty polyamine carboxylates, acyl polyethylene amine carboxylates, and the like, as described in detail in Chapter 5 of Lomax; the relevant disclosures of the aforementioned Chapters of Lomax being incorporated herein by reference.

As used herein, and in the appended claims, the term "anionic surfactant" and grammatical variations thereof, refers to a surfactant in which the hydrophilic portion of the surfactant carries no charge unless the pH is elevated to neutrality or above. Anionic surfactants include the chemical classes of: acylamino acids (and salts), such as acylgutamates, acyl peptides, sarcosinates, taurates, and the like; carboxylic acids (and salts), such as alkanoic acids (and alkanoates), ester carboxylic acids, ether carboxylic acids, and the like; phosphoric acid esters (and salts); sulfonic acids (and salts), such as acyl isethionates, alkylaryl sulfonates, alkyl sulfonates, alkyl sulfosuccinates (and salts), and the like; and sulfuric acid esters, such as alkyl ether sulfates, alkyl sulfates, and the like. A description of anionic surfactants can be found in numerous texts and monographs, such as Rieger, *Surfactant Encyclopedia,* $2^{nd}$ Ed., C&T Ingredient Resource Series of *COSMETICS AND TOILETRIES®* magazine, published by Allured Publishing Corporation, Carol Stream, Ill. (1996), the relevant disclosures of which are incorporated by reference.

A preferred method of preparing a pourable, pumpable, high concentration, liquid surfactant composition comprises the steps of (a) preparing an aqueous surfactant composition at an elevated temperature, in combination with a liquid-stabilizing amount of at least one liquid-stabilizing agent, followed by cooling the resulting high concentration, liquid surfactant composition.

The high concentration liquid surfactant composition is preferably prepared at an elevated temperature greater than about 30° C. but below the boiling point of the aqueous medium.

The liquid-stabilizing agent can be added before, during or after the preparation of the high concentration aqueous liquid surfactant composition. The liquid-stabilizing amount of liquid-stabilizing agent preferably is at least about 0.1% by weight, more preferably in the range of about 1% to not more than about 10% by weight of the liquid-stabilizing agent, most preferably not more than a range of 5% to about 8% by weight, based on the total composition weight, but is not limited thereto. Those skilled in the art will recognize that the amount of liquid-stabilizing agent will vary with the type of surfactant employed and can be readily determined by the practitioner. Thus, depending on the liquidity and total solids desired, more or less liquid-stabilizing agent may be employed.

In one method embodiment, the high concentration liquid surfactant composition can be prepared by synthesizing the surfactant in the presence of at least one liquid-stabilizing agent at an elevated temperature and then cooling the resulting liquid surfactant composition to ambient room temperature.

Alternatively, the high concentration liquid surfactant composition can be prepared by combining an already prepared substantially non-liquid, aqueous surfactant composition with at least one liquid-stabilizing agent at an elevated temperature and then cooling the resulting high concentration, liquid surfactant composition to ambient room temperature.

Preferably, the high concentration, liquid surfactant compositions have a total solids content greater than about 35% by weight. Surprisingly, the high concentration, liquid surfactant compositions of the present invention are stable, pourable and pumpable liquids even at total solids levels greater than about 40% by weight.

Preferably, the high concentration liquid surfactant composition has an active surfactant concentration of at least about 25% by weight, more preferably at least about 35% by weight based on the total composition weight.

In a particularly preferred method aspect of the present invention, a stable, pourable, pumpable, liquid amphoteric surfactant composition is obtained by first preparing a high concentration, aqueous, liquid amphoteric surfactant composition, at an elevated temperature, and then adding at least one liquid-stabilizing agent to the still hot surfactant composition. Preferably, the aqueous liquid amphoteric surfactant composition is prepared at a temperature in the range of about 50 to about 100° C., more preferably about 80 to about 90° C. Next, the resulting liquid amphoteric surfactant composition is cooled to ambient room temperature and can be packaged for storage, sale or future use.

The liquid amphoteric surfactant composition preferably contains an amphoteric surfactant concentration of at least about 25% by weight, more preferably at least about 30% by weight on a total composition weight basis. The concentration of the liquid-stabilizing agent is preferably at least about 0.1% by weight on a total composition weight basis. Preferably, the liquid stabilizing agent comprises not more than about 10% by weight of the composition, more preferably not more than 8% by weight, most preferably not more than about 5% by weight on a total composition weight basis.

A liquid-stabilizing agent can be added to a previously prepared aqueous amphoteric surfactant composition, or the amphoteric surfactant can be synthesized in the presence of a liquid-stabilizing agent. In a particularly preferred embodiment, the amphoteric surfactant is a betaine prepared by quaternizing a fatty amine or a fatty amidoamine with an ω-haloalkylcarboxylic acid in an aqueous medium having a basic pH. A liquid-stabilizing agent is preferably added to the aqueous medium after completion of the quaternization procedure. Alternatively, a liquid-stabilizing agent can be added to the aqueous reaction medium during the quaternization procedure or added prior to the initiation of the quaternization reaction.

Surprisingly, the liquid betaine compositions prepared by the methods of the present invention remain stable at a temperature of at least about ambient room temperature and above, at a total solids greater than about 40% by weight and at active betaine concentrations greater than about 35% by weight, based on total composition weight. Moreover, liquid betaine compositions had improved color, (substantially colorless), over liquid betaine compositions prepared by conventional methods and remained color stable on storage.

In another embodiment of the present invention, the surfactant is an anionic surfactant. Preferred anionic surfactants include alkyl sulfonates, especially, $C_{12-16}$ alpha olefin sulfonates (AOS), alkyl sulfates, alkyl ether sulfates, alkylaryl sulfonates, alkyl sulfosuccinates, and salts thereof. Particularly preferred anionic surfactants are an alkyl ether sulfonate, such as sodium laureth-2 sulfate (SLES-2), an AOS, such as sodium $C_{14-16}$ olefin sulfonate, and an alkyl sulfate, such as sodium coco-sulfate and sodium lauryl sulfate.

Preferred liquid-stabilizing agents useful in the compositions of the present invention include polyamino disuccinic acids, polyamino diglutaric acids, polyamino monosuccinic acids, polyamino monoglutaric acids, compounds having the general formula (I), compounds having general formula (II), combinations thereof, and salts thereof;

(I)

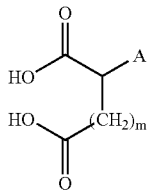

(II)

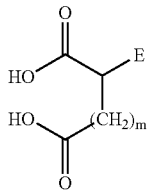

wherein in each of formulas (I) and (II) A is —NH($R^1$), —N($R^1$)($R^2$), or —NHCOY; E is —$SO_3H$, —$PO_3H_2$, —$OR^1$, —$SR^1$, or $C_4$-$C_{22}$ alkenyl; $R^1$ and $R^2$ are each independently —$(CH_2)_n$—OH, —$(CH_2)_n$—$SO_3H$, —$(CH_2)$—$PO_3H_2$, —$(CH_2)_n$—COOH, or —CH($R^3$)—COOH; $R^3$ is —$CH_2OH$, —$CH(CH_3)$—OH, —$CH_2SH$, —$CH_2CONH_2$, —$CH_2CH_2CONH_2$, —$CH_2COOH$, or —$CH_2CH_2COOH$; Y is saturated or unsaturated $C_1$-$C_{30}$ alkyl; n is an integer in the range of about 2 to about 6; and m is 1 or 2.

Polyamino disuccinic acids and polyamino diglutaric acids are compounds having two or more nitrogen atoms in which two of the nitrogen atoms are each bonded to the α-position (i.e., the 2-position) of a succinic acid or glutaric acid group. Suitable polyamino disuccinic acids are disclosed in U.S. Pat. No. 5,652,085 to Wilson et al., the relevant disclosures of which are incorporated herein by reference. The polyamino disuccinic acid compound has at least 2 nitrogen atoms, and preferably has no more than about 10 nitrogen atoms. Preferably, the succinic acid groups are on terminal nitrogen atoms, and most preferably each terminal nitrogen atom also has a hydrogen substituent.

Suitable polyamino diglutaric acids include compounds such as those disclosed in U.S. Pat. No. 5,652,085 to Wilson et al. wherein the succinic acid groups are replaced by glutaric acid groups. A preferred polyamino glutaric acid is ethylenediamine-N,N'-diglutaric acid.

The remaining bonds on nitrogens having a succinic or glutaric acid group are preferably filled by a hydrogen atom and alkylene group. The alkylene group can be linear, branched or cyclic, including cyclic structures joining more than one nitrogen atom or more than one bond of a single nitrogen atom. Preferably each alkylene group is linear. The alkylene groups can be joined with other alkylene groups by amino linkages, ether linkages, or a thioether linkages. Each of the alkylene groups preferably includes 2 to about 10 carbon atoms, more preferably 2 to about 6, and most preferably 2 to about 3 carbon atoms. Preferably, the alkylene groups are linked by amino linkages. The alkylene groups can optionally include non-charged polar substituents, such as hydroxyl substituents, and the like.

Preferred polyamino disuccinic and diglutaric acids useful in the compositions and methods of the present invention include compounds having the following general formulas (III), (IV), (V), and combinations thereof;

(III)

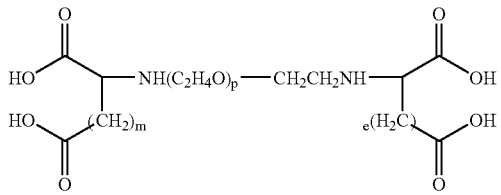

(IV)

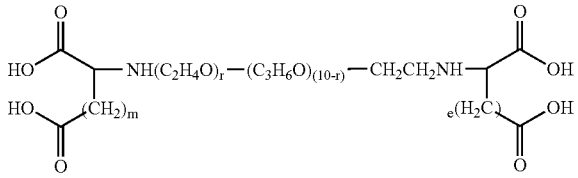

(V)

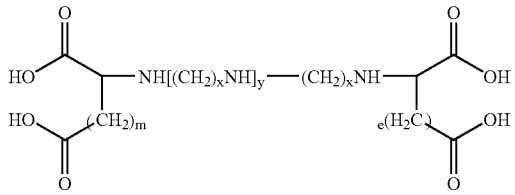

wherein in formulas (I), (IV) and (V), m and e are each independently 1 or 2; p and r are each independently 0 or an integer having a value in the range of 1 to about 10; x is an integer having a value in the range of 2 to about 6; and y is 0 or an integer having a value in the range of 1 to about 8. Compounds in which m and e are 1 are succinic acid derivatives and compounds in which m and e are 2 are glutaric acid derivatives. Compounds in which m is 1 and e is 2 are mixed succinic/glutaric acid derivatives.

Examples of preferred polyamino disuccinic and diglutaric acids include:

ethylenediamine-N,N'-disuccinic acid, (EDDS),
ethylenediamine-N,N'-diglutaric acid,
diethylenetriamine-N,N''-disuccinic acid (ETDS),
diethylenetriamine-N,N''-diglutaric acid (ETDS),
triethylenetetraamine-N,N'''-disuccinic acid,
1,6-hexamethylenediamine N,N'-disuccinic acid,
1,6-hexamethylenediamine N,N'-diglutaric acid,
tetraethylenepentamine-N,N''''-disuccinic acid,
2-hydroxypropylene-1,3-diamine-N,N'-disuccinic acid,
1,2-propylenediamine-N,N'-disuccinic acid,
1,3-propylenediamine-N,N'-disuccinic acid,
cis-cyclohexanediamine-N,N'-disuccinic acid,
trans-cyclohexanediamine-N,N'-disuccinic acid,
2-(2-aminoethyleneoxy)ethylamine-N,N'-disuccinic acid, and the like. A particularly preferred polyamino disuccinic acid is EDDS.

Useful polyamino disuccinic and diglutaric acids can be prepared by any process. For example, Kezerian et al. in U.S. Pat. No. 3,158,635 which is incorporated herein by reference, discloses reacting maleic anhydride (or ester or salt) with a polyamine corresponding to the desired polyamino disuccinic acid under alkaline conditions. The reaction yields a number of optical isomers, for example, the reaction of ethylenediamine with maleic anhydride yields a mixture of three optical isomers (R,R), (S,S) and (S,R) ethylenediamine disuccinic acid (EDDS), because there are two asymmetric carbon atoms in ethylenediamine disuccinic acid. These isomeric mixtures are used as mixtures or alternatively separated by means within the state of the art to obtain the desired isomer(s). Alternatively, (S,S) isomers are prepared by reaction of such acids as L-aspartic acid with compounds such as 1,2-dibromoethane as described by Neal and Rose, *Inorganic Chemistry*, vol. 7. (1968), pp. 2405-2412, and in U.S. Pat. No. 5,554,791 to Lin et al. the disclosures of each being incorporated herein by reference. Polyamino diglutaric acids can be prepared by analogous reactions that utilize the one carbon greater homologs of the succininc acid precursors.

Polyamino monosuccinic and monoglutaric acids are compounds having at least two nitrogen atoms, to which a succinic or glutaric acid group is attached to one of the nitrogen atoms at the α-position of the succinic or glutaric acid group. Suitable polyamino monosuccinic acids are described in U.S. Pat. No. 5,652,085 to Wilson et al., the relevant disclosures of which are incorporated herein by reference. Preferably the polyamino monosuccinic or monoglutaric acid compound has no more than about 10 nitrogen atoms, more preferably no more than about 6, most preferably 2 nitrogen atoms. Preferably, the succinic or glutaric acid group is on a terminal nitrogen atom. The polyamino monoglutaric acids are simply homologs of the polyamino monosuccinic acids having one extra methylene group.

The remaining bonds on the nitrogen atom bonded to the succinic or glutaric acid group are preferably filled by a hydrogen atom and alkylene group. The alkylene group can be linear, branched or cyclic, including cyclic structures joining more than one nitrogen atom or more than one bond of a single nitrogen atom. Preferably the alkylene group is linear. The alkylene group can be bonded to another alkylene group or a series of alkylene groups, each joined by amino linkages, ether linkages, or a thioether linkages. Each of the alkylene groups preferably includes 2 to about 10 carbon atoms, more preferably 2 to about 6, and most preferably 2 to about 3 carbon atoms. Preferably, the alkylene groups are linked by amino linkages. The alkylene groups can optionally include non-charged polar substituents such as hydroxyl substituents, and the like.

Preferred polyamino monosuccinic and monoglutaric acids useful in the compositions and methods of the present invention include compounds having the following general formulas (VI), (VII), (VIII), and combinations thereof;

(VI)

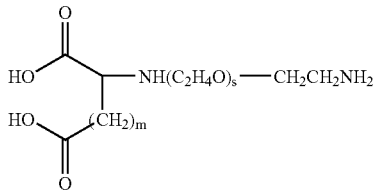

-continued (VII)

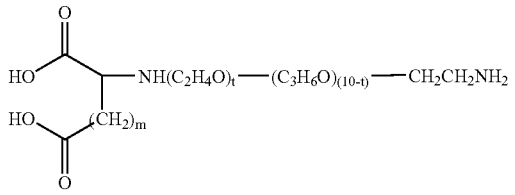

(VIII)

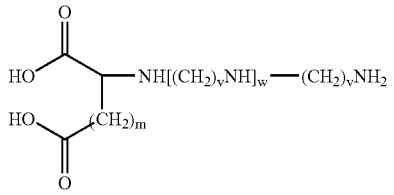

wherein in formulas (VI), (VII) and (VIII), s and t are each independently 0 or an integer having a value in the range of 1 to about 10; v is, an integer having a value in the range of 2 to about 6; w is 0 or an integer having a value in the range of 1 to about 8; and m is 1 or 2.

Examples of preferred polyamino monosuccinic and monoglutaric acids include:

ethylenediamine monosuccinic acid,
ethylenediamine monoglutaric acid,
diethylenetriamine monosuccinic acid,
diethylenetriamine monoglutaric acid,
triethylenetetraamine monosuccinic acid,
1,6-hexamethylenediamine monosuccinic acid,
1,6-hexamethylenediamine monoglutaric acid,
tetraethylenepentamine monosuccinic acid,
2-hydroxypropylene-1,3-diamine monosuccinic acid,
1,2-propylenediamine monosuccinic acid,
1,3-propylenediamine monosuccinic acid,
cis-cyclohexanediamine monosuccinic acid,
trans-cyclohexanediamine monosuccinic acid,
2-(2-aminoethyleneoxy)ethylamine monosuccinic acid, and the like. A particularly preferred polyamino monosuccinic acid is ethylenediamine monosuccinic acid.

Polyamino monosuccinic acids can be prepared, for example, by the process of Bersworth et al. in U.S. Pat. No. 2,761,874, the disclosure of which is incorporated herein by reference. Bersworth et al. disclose reacting alkylene diamines and dialkylene triamines under mild conditions with maleic acid esters (in an alcohol) to yield amino derivatives of N-alkyl substituted aspartic acid. The reaction yields a mixture of the R and S isomers. Polyamino monoglutaric acids are prepared by analogous reactions wherein the succinic acid precursors are replaced with the corresponding glutaric acid precursor.

Examples of preferred compounds of general formula (I) include:

iminodisuccinic acid (IDS),
iminodiglutaric acid,
2-(2-hydroxyethylamino)succinic acid,
2-(2-hydroxyethylamino)glutaric acid,
2-lauramidosuccinic acid (i.e., N-lauroylaspartamide),
2-lauramidoglutaric acid (i.e., N-lauroylglutamide),
2-(bis-(2-hydroxyethyl)amino)succinic acid,
2-(bis-(4-hydroxybutyl)amino)succinic acid,
2-(2-sulfoethylamino)succinic acid,
2-(3-sulfopropylamino)succinic acid, and the like.

Examples of preferred compounds of general formula (II) include:

2-sulfosuccinic acid,
2-octen-1-ylsuccinic acid (2-OSA),
1-octen-1-ylsuccinic acid (1-OSA),
2-sulfoglutaric acid,
2-phosphonosuccinic acid,
2-(carboxymethoxy)succinic acid,
2-(carboxymethyl)glutaric acid,
2-(2-sulfoethyleneoxy)succinic acid, and the like.

A particularly preferred compound of general formula (I) is IDS, which is commercially available from Bayer Corp., Pittsburgh, Pa. A particularly preferred compound of general formula (II) is 2-sulfosuccinic acid. Another particularly preferred compound of general formula (II) is an octenylsuccinic acid such as 2-OSA, 1-OSA and mixtures thereof.

For liquid anionic surfactant compositions of the present invention, such as alkyl ether sulfate and AOS compositions, a $C_4$-$C_{22}$ alkenylsuccinic acid or a salt thereof. Particularly preferred liquid stabilizing agents for anionic surfactant compositions include 2-OSA, 1-OSA, salts thereof (e.g., mono and disodium salts of OSA), and mixtures thereof.

Compounds of general formulas (I) and (II) can be prepared, for example by the methods described in U.S. Pat. No. 3,954,858 to Lamberti, et al., the relevant disclosure of which is incorporated herein by reference, and in EP patent application 0591934 published Apr. 13, 1994. Sulfosuccininc acid and octenyl succinic acids (or anhydrides thereof) are commercially available from a number of chemical sources well known to those skilled in the chemical arts.

Betaines useful in the compositions and methods of the present invention preferably have the following general formula (X);

(X)

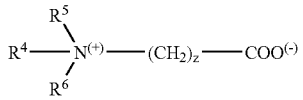

wherein $R^4$ is a saturated or unsaturated linear alkyl having at least about 8 carbon atoms or $R^7CONH(CH_2)_k$; $R^7$ is a saturated or unsaturated alkyl group having at least about 7 carbon atoms; k is 2 or 3; $R^5$ and $R^6$ are each independently $C_1$-$C_4$ alkyl, and z is 1, 2, or 3.

Betaines useful in the compositions and methods of the present invention include, without limitation, compounds prepared by the quaternization of at least one amine, such as a fatty amine or a fatty amidoamine with at least one ω-haloalkylcarboxylic acid or a salt thereof, such as chloroacetic acid, 2-chloropropionic acid, 3-bromobutyric acid, and alkali metal salts thereof, in an aqueous medium having a basic pH. Preferably the pH of the aqueous medium is greater than about 9, more preferably greater than about 10, and most preferably in the range of about 10 to about 13.

Fatty amines suitable for quaternization preferably have the following general formula (IX),

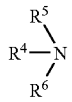

(IX)

wherein $R^4$ is a saturated or unsaturated linear alkyl having at least about 8 carbon atoms, and $R^5$ and $R^6$ are each independently $C_1$-$C_4$ alkyl. Preferred $R^4$ groups include, without limitation, lauryl, myristyl, cetyl, stearyl, oleyl, behenyl, and the like. The fatty amine can be a mixture of fatty amines derived from natural oils and fats such as coco amine, tallow amine, and the like.

Amidoamines suitable for quaternization preferably have the general formula (IX), wherein $R^4$ is $R^7CONH(CH_2)_k$, $R^7$ is a saturated or unsaturated alkyl group having at least about 7 carbon atoms, k is 2 or 3; and $R^5$ and $R^6$ are each independently $C_1$-$C_4$ alkyl. $R^7$ preferably has 7 to about 30 carbons and can be derived from natural fatty acids, oils, or fats, such as from coconut, tallow, soy, and the like.

In one preferred embodiment, $R^4$ is a saturated or unsaturated fatty alkyl group such as lauryl, myristyl, palmityl, stearyl, oleyl, behenyl, and the like; or $R^4$ can be a mixture of alkyl groups derived from natural oils or fats such as coconut oil, palm kernel oil, babassu oil, castor oil, canola oil, tallow, olive oil, corn oil, soybean oil, and the like; $R^5$ and $R^6$ are most preferably methyl, and z is preferably 1. An extensive listing and discussion of natural oils and fats suitable for use can be found in O'Lenick and Steinberg, *Primary Ingredients*, Klein (ed), published by Hansotech, Inc. (1998), incorporated herein by reference.

Most preferably the $R^4$ alkyl groups are derived from coconut oil. Other particularly preferred $R^4$ alkyl groups are lauryl, myristyl, palmityl, and mixtures thereof.

In another preferred embodiment $R^4$ is $R^7CONH(CH_2)_k$, k is preferably 3, and $R^7$ is preferably derived from lauric, myristic, palmitic, stearic or oleic acids; most preferably from coconut, babassu, or palm kernel fatty acids.

Particularly preferred betaine surfactants include: lauramidopropyl betaine, myristamidopropyl betaine, palmitamidopropyl betaine, cocamidopropyl betaine, palm kernelamidopropyl betaine, babassuamidopropyl betaine, cocobetaine, lauryl betaine, myristyl betaine, cetyl betaine, cocamidopropyl hydroxysultaine, lauramidopropyl hydroxysultaine, palm kernelamidopropyl hydroxysultaine, babassuamidopropyl hydroxysultaine, myristamidopropyl hydroxysultaine, and a combination thereof.

Preferred imidazoline-derived amphoteric surfactants include imidazoline carboxylates such as the reaction product of a 1-hydroxyethyl-2-fatty alkyl imidazolines with an ω-haloalkylcarboxylic acid, such as chloroacetic acid, and like materials. The reaction products can be monocarboxylates or dicarboxylates. Alternatively, the imidazoline can be alkylated with an α,β-unsaturated carboxylic acid, such as acrylic or methacrylic acid, or a salt thereof to afford so-called salt-free amphoteric surfactants.

Examples of preferred imidazoline monocarboxylates include, without limitation, cocoamphoacetate, cocoamphopropionate, lauramphoacetate, lauroamphopropionate, caproamphoacetate, caproamphopropionate, stearamphoacetate, stearamphopropionate, and the like.

Examples of preferred imidazoline dicarboxylates include, without limitation, cocoamphodiacetate, cocoamphodipropionate, lauramphodiacetate, lauramphodipropionate, caproamphodiacetate, caproamphodipropionate, stearamphodiacetate, stearamphodipropionate, and the like.

Other preferred imidazoline-derived surfactants include fatty imidazoline sulfonates, such as cocoamphohydroxypropyl sulfonate, oleamphohydroxypropylsulfonate, capryloamphohydroxypropylsulfonate, and the like. Such sulfonated fatty imidazoline can be prepared by alkylation of a fatty imidazoline, such as 1-hydroxyethyl-2-fatty alkyl imidazoline with 2-hydroxypropane sultone.

Examples of preferred alkyl polyamine carboxylates include, without limitation, reaction products of ω-haloalkylcarboxylic acids or acrylic acid and a fatty polyamine, as described in Lomax, Chapter 5. Examples of preferred fatty polyamines include, without limitation, compounds having the formula (XII) and salts thereof, $$R^8—NH—(CH_2CH_2CH_2—NH)_d—CH_2CH_2—CO_2H \quad (XII)$$

wherein $R^8$ is a linear or branched, saturated or unsaturated $C_8$-$C_{30}$ alkyl and d is 1, 2 or 3. Examples of preferred $R^8$ groups include lauryl, stearyl, oleyl, and the like, and mixtures of fatty alkyl groups derived from natural oils and fats, such as coconut oil, tallow, soybean oil, sunflower seed oil, safflower oil, canola oil, corn oil, and the like.

Examples of preferred amino acid amphoterics include amino carboxylic acids, such as $C_1$-$C_{30}$ alkyl amino propionates, $C_1$-$C_{30}$ alkyl amino glycinates, and the like, the preparation of which are described in Lomax, Chapter 2. Other preferred amino acid amphoterics include $C_1$-$C_{30}$ alkyl amino propane sulfonic acids, $C_1$-$C_{30}$ alkyl amine ethane sulfonic acids, and the like; the preparation of which are described in Lomax, Chapter 2.

Examples of preferred sulfobetaines (sultaines) include, without limitation, cocamidopropyl hydroxysultaine, lauramidopropyl hydroxysultaine, stearamidopropyl hydroxysultaine, cocamidopropyl sultaine, and the like. Sultaines are well known in the art and are commercially available from a number of sources, such as the McIntyre Group, Ltd., University Park, Ill.

The high concentration liquid surfactant compositions of this invention can be employed in cold processing processes, practiced in the manufacture of consumer products for personal care, health care, and industrial products, especially products, such as cleansers where surfactants are desired.

The following non-limiting examples are provided to illustrate preferred embodiments of the present invention.

Chemical reagents and ingredients employed in the following examples are referred to herein by their commonly used chemical names or by the international nomenclature commonly known to as INCI name given them in the *International Cosmetic Ingredient Dictionary*, Volumes I and II, Sixth Edition, (1995), or *International Cosmetic Ingredient Dictionary and Handbook*, Volumes I-III, Seventh Edition, (1997), both published by the Cosmetic, Toiletry, and Fragrance Association, Washington D.C. (both hereafter INCI Dictionary). Commercial suppliers of materials employed, listed by INCI name, trade name or both, can be found in the INCI Dictionary and in chemical supplier catalogs, and in commercial trade publications, including but not limited to the 2001 *McCutcheon's* Directories, Volume 1: Emulsifiers & Detergents and Volume 2: Functional Materials, published by McCutcheon's Division, The Manufacturing Confectioner Publishing Co. Glen Rock, N.J. (2001); and 2001 *Cosmetic Bench Reference*, edition of *COSMETICS & TOILETRIES®*, 115 (13), published by Allured Publishing Corporation, Carol Stream, Ill. (2001); the relevant disclosures of each are incorporated herein by reference.

The following examples illustrate high concentration liquid amphoteric surfactant, and anionic surfactant, compositions prepared employing liquid-stabilizing agents that are succinic acid derivatives which remain flowable, pumpable liquids at ambient room temperature of about 22° C. Unless indicated otherwise, all reagents solutions employed were aqueous solutions.

EXAMPLE 1

Preparation of Betaine Composition A

Materials used in the preparation of highly concentrated betaine Composition A are provided in Table 1.

TABLE 1

| Ingredient | Parts by Weight (As Is) |
|---|---|
| Deionized water | 48 |
| Trisodium sulfosuccinate (39%) | 10 |
| Cocamidopropyl dimethylamine | 29 |
| Sodium monochloroacetate (SMCA) | 12 |
| Sodium hydroxide (50%) | 1 |
| Sulfuric acid (96%) | 0.1 |

About 150 grams of trisodium sulfosuccinate solution was combined in a glass reactor with about 708 grams water to form a sulfosuccinate solution. About 192 grams of SMCA was then added to the sulfosuccinate solution, followed by about 450 grams of cocamidopropyl dimethylamine. The resulting reaction mixture was heated at about 90° C., with mixing agitation, to quaternize the amine and produce a solution of cocamidopropyl betaine. The pH (10% aqueous) of the reaction mixture was maintained in the range of about 8 and about 10.5 by the addition of sodium hydroxide solution. After about 12 hours, an additional 50 grams of water was added and the pH (as is) was adjusted to about 7 by the addition of about 2 grams of sulfuric acid. The resulting betaine solution was cooled to ambient room temperature of about 22° C., discharged from the reactor into a storage container for future use. The product, betaine Composition A, was a substantially colorless (pale yellow), clear, highly concentrated, flowable, liquid (about 45.6% total solids with about 6.12% sodium chloride content). Surprisingly, Composition A remained flowable at a temperature as low as about 5° C. The betaine Composition A remained substantially unchanged on storage aging at ambient room temperature in the range of about 20 to about 25° C. for at least six months.

In contrast, it is known from experience that a similar betaine composition prepared in the conventional manner without the liquid-stabilizing agent would gel under the same storage conditions.

EXAMPLE 2

Preparation of Betaine Composition B

Materials used in the preparation of highly concentrated betaine Composition B are provided in Table 2.

TABLE 2

| Ingredient | Parts by Weight (As Is) |
|---|---|
| Deionized water | 52 |
| Cocamidopropyl dimethylamine | 29 |
| Sodium chloroacetate | 12 |
| Sulfosuccinic acid (70%) | 3 |
| Sodium hydroxide (50%) | 3.5 |
| Hydrochloric acid (38%) | 0.8 |
| Sodium borohydride (12% by weight in aqueous 50% sodium hydroxide) | 0.1 |

About 24 grams of sodium hydroxide solution and about 20.6 grams of sulfosuccinic acid were combined with about 370 grams of water in a glass reactor. The resulting mixture was heated at about 55° C. with mixing agitation. About 205.5 grams of cocamidopropyl dimethylamine was added to the heated mixture, followed by about 82 grams of SMCA. The resulting reaction mixture was heated at about 85° C. to quaternize the amine and produce a betaine solution. The pH (10% aqueous) of the reaction mixture was maintained in the range of about 9 and about 10.5 by the addition of about 0.6 grams of sodium hydroxide solution. After about 12 hours, about 0.68 grams of sodium borohydride solution was added to the betaine solution. The betaine solution was then cooled to ambient room temperature of about 22° C. and the pH (as is) was adjusted to about 5.2 by the addition of about 5.5 grams of hydrochloric acid, and was discharged from the reactor into a storage container for future use. The product cocamidopropyl betaine, Composition B, was a substantially colorless (pale yellow) clear, highly concentrated, flowable liquid (about 44.2% total solids with about 6.4% sodium chloride content). Surprisingly, Composition B remained flowable at a temperature as low as about 0° C. Betaine Composition B remained color stable on storage aging at ambient room temperature for at least six months.

EXAMPLE 3

Preparation of Betaine Composition C

Materials used in the preparation of betaine Composition C are provided in Table 3.

TABLE 3

| Ingredient | Parts by Weight (As Is) |
|---|---|
| Deionized water | 55 |
| Cocamidopropyl dimethylamine | 30 |
| Sodium chloroacetate | 12 |
| Sodium iminodisuccinate (IDS) | 3 |
| Sodium hydroxide (50%) | 0.4 |
| Hydrochloric acid (38%) | 0.7 |
| Sodium borohydride (12% by weight in aqueous 50% sodium hydroxide) | 0.2 |

About 21 grams of IDS was combined with 378 grams of water in a glass reactor, and the resulting solution was heated to about 50° C. About 215 grams of cocamidopropyl dimethylamine was added to the IDS solution, followed by about 86.1 grams of SMCA, and the resulting mixture was heated at about 88° C. to quaternize the amine and produce a betaine solution. The pH (10% aqueous) of the reaction mixture was maintained in the range of about 9 and about 10.5 by the addition of sodium hydroxide solution (about 3 grams total). After about 12 hours, about 1.3 grams of a sodium borohydride solution was added to the betaine solution. The reaction mixture was then cooled to ambient room temperature of about 22° C. the pH was adjusted to about 5.1 by the addition of about 5 grams of hydrochloric acid. An additional 15 grams of water was then added to the solution, which was subsequently discharged from the reactor into a storage container for future use. The product cocamidopropyl betaine Composition C, was a substantially colorless, clear, highly concentrated, flowable liquid (about 45.5% total solids and about 6.58% sodium chloride content). Surprisingly, Composition C remained flowable at a temperature as low as about 7° C. The composition was stable at ambient room temperature for more than six months.

EXAMPLE 4

Preparation of Betaine Composition D

About 5 grams of sodium iminodisuccinate (IDS) and previously manufactured (about one week old) substantially non-liquid composition of cocamidopropyl betaine having a total solids of about 41.3% with a sodium chloride content of about 6.9% were combined in a glass reactor, with mixing agitation, at a temperature of about 80° C. The pH was subsequently adjusted to about 5.4 with sulfuric acid (96%). The resulting cocamidopropyl betaine Composition D, was a substantially colorless, clear, highly concentrated flowable liquid having about 44.8% total solids with about 6.5% sodium chloride content. Surprisingly, Composition D remained flowable at a temperature as low as about 5° C.

EXAMPLE 5

Preparation of Betaine Composition E

Materials used in the preparation of betaine Composition E are provided in Table 4.

TABLE 4

| Ingredient | Parts by Weight (As Is) |
|---|---|
| Deionized water | 46 |
| Cocamidopropyl dimethylamine | 30 |
| Sodium chloroacetate | 12 |
| EDDS (28%) | 10 |
| Sodium hydroxide (50%) | 0.7 |
| Sulfuric Acid (96%) | 1 |

About 86 grams of sodium chloroacetate was dissolved in about 330 grams of deionized water at a temperature of about 60° C. About 73 grams of 28% by weight ethylenediamine-N,N'-disuccinic acid trisodium salt (EDDS) solution was added to the chloroacetate solution, followed by about 215 grams of cocamidopropyl dimethylamine. The resulting solution was heated to a temperature of about 90° C. to quaternize the amine. The pH of the solution was maintained in the range of about 9 to about 10.5 during the quaternization reaction by addition of 50% by weight sodium hydroxide solution. After about four hours, the reaction mixture was cooled to ambient room temperature, the pH was adjusted to about 5.9 with hydrochloric acid (38%), and the composition was discharged from the reactor into a storage bottle. The resulting cocamidopropyl betaine Composition E was a slightly hazy liquid having a total solids of about 45% by weight and a sodium chloride content of about 6.9% by weight. Composition E was flowable at a temperature as low as about 3° C. Composition E was stable at ambient room temperature for more than six months.

Each of Compositions A-E remained color stable and a flowable liquid and there was no evidence of gel formation or precipitation in any of the compositions at a temperature of about 10° C. and above. Each of the betaine compositions containing liquid-stabilizing agent (Compositions A-E) remained liquid at such low temperatures at higher concentrations of betaine than betaine solutions that did not contain the liquid-stabilizing agent. These high concentration liquid betaine compositions are particularly useful as flowable, pumpable, ingredients for personal care products, where it is desirable to provide active ingredients in as high a concentration as possible to provide maximum flexibility to the personal care product formulator.

EXAMPLE 6

Preparation of Anionic Surfactant Composition

This example illustrates the use in an anionic surfactant composition of an octenylsuccinic acid liquid-stabilizing agent. An aqueous disodium octenylsuccinate (about 34%) was prepared from octenyl succinic anhydride (OSA from Dixie Chemical, Houston, Tex.) and aqueous sodium hydroxide. According to the manufacturer of the OSA, this material is reportedly predominantly 1-OSA, but some 2-OSA is also present.

About 3 parts by weight of the liquid-stabilizing agent solution was added to about 95 parts by weight of sodium laureth-2 sulfate (about 29% active SLES-2) and the resulting combination was admixed by shaking it in a jar at ambient room temperature of about 22° C. for about one minute.

Surprisingly, the anionic surfactant composition, which had a total solids of about 29.8%, was a substantially clear liquid having a Brookfield viscosity of about 56 mPa·s at a temperature of about 25° C. In contrast, aqueous SLES-2, without the liquid stabilizing agent, having a total solids content of about 29.7%, was hazy and viscous (Brookfield viscosity of about 10,135 mPa·s) at about 25° C.

Examples 7, 8 and 9 illustrate the beneficial effects of adding sodium iminodisuccinate (IDS) to previously prepared, highly concentrated alkylamidopropyl betaine compositions.

EXAMPLE 7

Preparation of Betaine Composition F

A Master Batch of a concentrated betaine was prepared as follows:

About 114.9 grams of SMCA was combined with about 490 grams of water in a glass reactor with mixing agitation. The resulting solution was heated to about 50° C. About 300.7 grams of cocamidopropyl dimethylamine (derived from hydrogenated coconut oil) was added to the solution and the resulting mixture was heated at a temperature of about 90° C. to quaternize the amine and produce a betaine solution. The pH (10% aqueous) of the reaction mixture was maintained in the range of about 9 and about 10.5 by the addition of aqueous sodium hydroxide solution (50%, about 2 grams total). After about 8 hours, the SMCA content was less than about 100 ppm, and the free amine content was less than about one percent. About one gram of sodium borohydride (12% in 50% NaOH solution) was then added. The Master Batch was then divided into three portions, A, B & C.

Portion A—About 259 grams of the Master Batch was combined with about 21.7 grams of 34% IDS solution, stirred until homogeneous at a temperature of about 90° C., and then cooled to ambient temperature (about 20° C., at which temperature it remained a flowable liquid. About 4.7 grams of hydrochloric acid solution (about 37%) was then added to adjust the pH to about 5.7. The resulting concentrated betaine solution was a substantially colorless, clear, flowable liquid having about 45.8% total solids, about 6.9% sodium chloride content, and a viscosity at 25° C., of about 70 mPa·s. The concentrated liquid betaine remained flowable at or above a temperature of about −9° C.

Portion B—About 269 grams of the Master Batch was combined with about 3.8 grams of hydrochloric acid (37%) and about 10 grams of water and then cooled to ambient temperature (about 20° C.). The resulting betaine composition had about 45% total solids, about 7.1% sodium chloride, and a pH of about 5.4. The betaine composition was a substantially solid, non-flowable gel at a temperature below about 44° C.

Portion C (the remainder of the Master Batch) was left as is, resulting in a concentrated betaine containing about 46.9 total solids, about 6.58 percent sodium chloride, and pH of about 9. The betaine was a substantially solid non-flowable gel at a temperature below about 51° C.

EXAMPLE 8

Preparation of Betaine Composition G

A Master Batch of concentrated betaine was prepared as follows:

About 227.6 grams of cocamidopropyl dimethylamine (derived from stripped, hydrogenated coconut oil, substantially glycerine free and having an alkyl distribution with a maximum of about 1% percent $C_8$ and $C_{10}$) was combined with about 432.4 grams of water in a glass reactor with mixing agitation. The resulting solution was heated to a temperature of about 75° C. About 90 grams of SMCA was added and the resulting mixture was heated at a temperature of about 90° C. to quaternize the amine and produce a concentrated betaine solution. The pH (10% aqueous) of the reaction mixture was maintained in the range of about 9 to about 10.5 by the addition of sodium hydroxide solution (50%, about 3.5 grams total). After about 10 hours, the SMCA content was less than about 100 ppm, and the free amine content was less than about one percent. The Master Batch was then divided into three portions, A, B, and C.

Portion A—About 255 grams of the Master Batch was combined with about 7.3 grams of powdered, substantially dry, sodium iminodisuccinate (IDS) in another glass reactor with mixing agitation at a temperature of about 90° C. and mixed for about one hour. The resulting concentrated betaine mixture was cooled to ambient room temperature at which it remained a flowable liquid. The pH was then adjusted to about 6.4 with about 2 grams hydrochloric acid solution (37%). The resulting betaine solution was a substantially colorless, clear flowable liquid having about 44% total solids, with about 6.5% sodium chloride content, a pH of about 6.4, and a viscosity at about 25° C. of about 110 mPa·s. The concentrated betaine remained flowable at a temperature of about 8° C. and above.

Portion B—About 300 grams of the Master Batch was combined with about 1 gram of hydrochloric acid (37%) and then cooled to ambient temperature (about 20° C.). This resulted in a betaine composition with about 42.6 total solids, about 6.4% sodium chloride, and a pH of about 6.4. The betaine composition was a solid, non-flowable gel at a temperature below about 52° C.

Portion C—(About 50 grams of the Master Batch) was left unadjusted, resulting in a betaine composition containing about 42.6 total solids, about 6.2% sodium chloride and had a pH of about 10.5. The betaine was a substantially solid, non-flowable gel at about a temperature below about 49° C.

EXAMPLE 9

Preparation of Betaine Composition

A Master Batch of concentrated betaine was prepared as follows:

About 200.9 grams of alkylamidopropyl dimethylamine (60% caprylic, 40% capric) was combined with about 300 grams of water in a glass reactor with mixing agitation. The resulting solution was heated to a temperature of about 77° C. About 101.5 grams of SMCA was then added and the resulting mixture was heated to a temperature of about 90° C. to quaternize the amine and produce a betaine solution. The pH (10% aqueous) of the reaction mixture was maintained in the range of about 9 to about 10.5 by the addition of sodium hydroxide solution (50%, about 6 grams total). After about 10 hours, the SMCA content was less than about 100 ppm, and the free amine content was less than about one percent. The concentrated betaine was then divided into three portions, A, B, and C.

Portion A—About 234 grams of the Master Batch was combined with about 6.2 grams of powdered, substantially dry, sodium iminodisuccinate (IDS) in another glass reactor with mixing agitation at a temperature of about 90° C. and mixed for about one hour. The resulting concentrated betaine composition was cooled to ambient temperature (about 20° C.) at which temperature it remained a flowable liquid. The pH was adjusted to about 5.3 with about 8 grams hydrochloric acid (20%). The resulting concentrated betaine composition was a light amber, clear, flowable liquid having about 52% total solids, about 9.1% sodium chloride content and a viscosity at 25° C. of about 375 mPa·s. The liquid concentrated betaine composition remained flowable at a temperature of about 0° C. and higher.

Portion B—About 200 grams of the Match Batch was combined with about 4 grams of hydrochloric acid (20%) and then cooled to ambient temperature (about 20° C.). The resultant betaine composition had about 51.1% total solids, about 9% sodium chloride, and a pH of about 5.1. The concentrated betaine composition was a substantially solid, non-flowable gel at a temperature below about 33° C.

EXAMPLE 10

Preparation of a Hydroxysultaine Composition

A Master Batch of concentrated hydroxysultaine was prepared as follows:

About 650 grams of commercially available (previously manufactured) liquid solution of cocamidopropyl hydroxysultaine, having a total solids of about 47.8% and a sodium chloride content of about 6.14%, was heated in a glass reactor, with mixing agitation, to a temperature of about 95° C. About 127 mmHg (5 in. Hg) of vacuum were applied until about 50 grams of water had distilled from the solution. The Master Batch was then divided into two portions A and B.

Portion A—About 250 grams of the above concentrated solution was combined in another glass reactor with about 7.35 grams of powdered, substantially dry, sodium iminodisuccinate (IDS) at a temperature of about 77° C. and mixed for about one hour. The resulting surfactant solution was a substantially colorless, clear, flowable liquid having about 52.9% total solids, with about a 6.6% sodium chloride content, and a pH of about 8.7. About two grams of hydrochloric acid (37%) solution were then added to adjust the pH. The resulting concentrated surfactant solution was a substantially colorless, clear, flowable liquid having about 52.9% total solids, about a 6.9% sodium chloride content and a pH of about 7.9 and a viscosity at 25° C. of about 176 mPa·s. The liquid concentrated surfactant remained flowable at a temperature at or above about −2° C.

A portion (B)—About 250 grams of the concentrated surfactant solution was left unadjusted and cooled to ambient temperature. The resulting surfactant composition was a substantially solid, unflowable gel at a temperature of about 57° C. and below. The surfactant composition had a total solids content of about 51.5%, a sodium chloride content of about 6.8%, and a pH of about 8.0.

EXAMPLE 11

Pilot Scale Preparation of Concentrated Betaine

This example illustrates a preferred pilot plant scale up procedure for preparing the following highly concentrated liquid cocamidopropylbetaine having a cocamidopropylbetaine content of about 37% by weight, a sodium iminodisuccinate content of about 2.5 to about 3% by weight, a sodium chloride content of about 4.5 to about 7.3% by weight, and a water content of about 52 to about 56% by weight, based on the total composition weight.

A 585 pound batch can be prepared as follows:

About 46 pounds of a 34% sodium iminodisuccinate (IDS) solution is charged into about 354 pounds of soft water having a temperature in the range of about 50 to 55° C. under a nitrogen sparge. About 178 pounds of cocamidopropyldimethylamine (MACKINE™ CG-80, McIntyre Group, Ltd.) is then charged into the resulting IDS solution. About 69 pounds of sodium monochloroacetate (SMCA) is then added. The reaction mixture is then heated to a temperature in the range of about 80 to about 90° C., and the pH is adjusted to a value in the range of about 9 to about 9.5 with aqueous (50%) sodium hydroxide. The pH (at 10% solution), the SMCA level, and the free amine level are monitored periodically, and the pH is maintained throughout the quaternization reaction at a value in the range of about 9 to about 10 by addition of aqueous (50%) sodium hydroxide. After the SMCA level drops below about 1000 ppm, the pH of the mixture is raised to a value in the range of about 10 to about 11 with aqueous (50%) sodium hydroxide and the reaction mixture is heated to a temperature in the range of about 90 to about 95° C., and maintained in that temperature range until the SMCA level falls below about 50 ppm. A total of about 5 pounds of aqueous (50%) sodium hydroxide may be utilized during the entire process. Sodium borohydride (about 0.6 pounds of a 0.1% solution) is then slowly added to the reaction mixture. After the borohydride addition is complete, the reaction mixture is cooled to a temperature in the range of about 40 to about 50° C. and the pH is adjusted to a value in the range of about 4.5 to about 5.5 with an acid, preferably hydrochloric acid (20° Bè, about 31%), and the solids level can be adjusted to the target value of 44% to 45% by addition of water if needed.

A highly concentrated liquid, flowable betaine composition can be prepared by the above procedure to have a total solids content of about 44% to about 45%, not more than about 0.5% free cocamidopropyldinethylamine, and not more than about 0.5% free coconut fatty acid and a pH in the range of about 4.5 to about 5.5. The so-prepared betaine composition remains liquid, movable and pumpable at a temperature of at least about 20° C. and higher.

EXAMPLE 12

Preparation of Concentrated Betaine

This example illustrates a preferred production plant scale procedure for preparing the following highly concentrated liquid cocamidopropylbetaine have a cocamidopropylbetaine content of about 37% by weight, a sodium iminodisuccinate content of about 2.5 to about 3% by weight, a sodium chloride content of about 4.5 to about 7.3% by weight and a water content of about 52 to about 56% by weight, based on total composition weight.

A 10,000 pound batch was prepared as follows:

About 4,900 pounds of soft water were charged into the reaction vessel and placed under a nitrogen sparge. About 1,149 pounds of sodium monochloroacetate (SMCA) were charged into the water and the mixture was heated to a temperature in the range of about 45 to about 55° C., at which time, the nitrogen sparge was turned off and about 3,007 pounds of cocamidopropyldimethylamine (MACKINE™ CG-80, McIntyre Group, Ltd.) was then charged gradually into the mixture. The temperature of the reaction mixture was then raised to a range of about 80 to about 90° C., and the pH was adjusted to a value of at least 9 with aqueous (50%) sodium hydroxide. The pH (at 10% solution), the SMCA level, and the free amine level were monitored periodically, and the pH was maintained throughout the reaction at a value in the range of about 9 to about 10 by addition of aqueous (50%) sodium hydroxide. After the SMCA level dropped below about 1000 ppm, the pH of the mixture was raised to a value in the range of at least about 10 with aqueous (50%) sodium hydroxide and the temperature of the reaction mixture was raised to and maintained at a temperature of at least about 90° C., until the SMCA level fell below about 50 ppm. Sodium borohydride (about 10 pounds of a 0.1% solution) was then slowly added to the reaction mixture. After the borohydride addition was complete, about 764 pounds of aqueous (34%) sodium iminodisuccinate (IDS) solution were added to the reaction mixture and admixed until homogeneous. The reaction mixture was then cooled to a temperature in the range of about 40 to about 50° C., and the pH was adjusted to about 4.5 to about 5.5 with hydrochloric acid (20° Bè, about 31%), and the solids level was adjusted to the target value of 44 to 45% by addition of water.

The highly concentrated liquid, flowable, betaine composition can be prepared by the above procedure had a total solids content of about 44% to about 45%, not more than about 0.5% free cocamidopropyldimethylamine, not more than about 0.5% free coconut fatty acid, and a pH in the range of about 4.5 to about 5.5. The so-prepared betaine composition remained liquid, flowable, and pumpable at a temperature of at least about 20° C. and higher.

EXAMPLE 13

Preparation of Anionic Surfactant Composition

This example illustrates the use in an anionic surfactant composition of an octenylsuccinic acid liquid-stabilizing agent. An aqueous disodium octenylsuccinate (about 35%) was prepared from octenyl succinic anhydride (OSA from Dixie Chemical, Houston, Tex.) and aqueous sodium hydroxide. According to the manufacturer of the OSA, this material is reportedly predominantly 1-OSA, but some 2-OSA is also present.

Sodium $C_{14-16}$ olefin sulfonate (AOS) having about 40% active solids (BIO-TERGE® AS-40, Stepan Company), was heated to evaporate sufficient water to a provide a still flowable AOS having an active solids content of about 45%. About 10 parts by weight of the aqueous liquid-stabilizing agent solution was added to about 90 parts by weight of AOS, providing a liquified blend having a calculated active solids content of about 44%. The resulting liquified blend was then heated to further evaporate sufficient water to provide a flowable concentrated AOS having a total solids content of about 53%, and an active AOS content of about 49%.

EXAMPLE 14

Preparation of Anionic Cocosulfate Surfactant Composition

This example illustrates the use in an anionic surfactant composition of an octenylsuccinic acid liquid-stabilizing agent. An aqueous disodium octenylsuccinate (about 35%) was prepared as described in Example 13.

A suspension of about 35 parts by weight of solid sodium cocosulfate (MACKOL™ CAS-100F, McIntyre Group Ltd., about 93% active) in about 58 parts by weight water was prepared at an ambient temperature of about 25° C. About 7 parts by weight of the solution of disodium octenylsuccinate (i.e., the aqueous liquid-stabilizing agent) was added to the sodium cocosulfate suspension. The resulting cocosulfate composition was a substantially clear, flowable, low viscosity liquid having a total solids content of about 37.5%, and an active sodium cocosulfate content of about 35%. After about one week at a temperature of about 25° C. the liquid composition became opaque and thickened, but surprisingly remained a flowable paste. By way of comparison, a 35% active, aqueous sodium cocosulfate composition was prepared from about 35 parts by weight of sodium cocosulfate and about 65 parts by weight water, without added liquid-stabilizing agent, and initially was a clear, viscous solution but thickened to a non-flowable, opaque paste after about one week at about 25° C.

EXAMPLE 15

Antimicrobial Effectiveness of Concentrated Betaine

A concentrated liquid betaine having a cocoamidopropylbetaine content of about 37% by weight, a iminodisuccinate content of about 2.5 to about 3% by weight, a sodium chloride content of about 4.5 to about 7.3% by weight, and a water content of about 52 to about 56% by weight, based on total composition weight, was subjected to a microbial challenge test, such as the well known Mixed Inoculum Preservative Efficacy Test, against five organisms to assess antimicrobial effectiveness. The concentrated liquid betaine was antimicrobially effect (i.e., passed test) against bacteria (*Staphlococcus aureus, Pseudomonas aeruginosa, Escherichia coli*), and yeast (*Candida albicans*) within seven days, and against mold (*Aspergillus niger*) within 14 days. The composition was judged antimicrobially effective.

Numerous variations and modifications of the embodiments described above can be effected without departing from the spirit and scope of the novel features of the invention. It is to be understood that no limitations with respect to the specific embodiments illustrated herein are intended or should be inferred. The appended claims are intended to cover the above description and all such modifications as fall within the scope of the claims.

We claim:

1. A pourable, pumpable, high concentration, aqueous, liquid surfactant composition consisting of:

(a) at least one surfactant selected from the group consisting of an amphoteric surfactant and an anionic surfactant;

(b) at least about 0.1% by weight on a total composition weight basis of at least one liquid-stabilizing agent selected from the group consisting of a compound of formula (I) and a salt thereof;

(I)

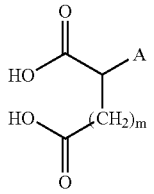

wherein A is —NH($R^1$), —N($R^1$)($R^2$), or —NHCOY; $R^1$ and $R^2$ are each independently —$(CH_2)_n$—OH, —$(CH_2)_n$—$SO_3H$, —$(CH_2)_n$—$PO_3H_2$, —$(CH_2)_n$—COOH, or —CH($R^3$)—COOH; $R^3$ is —$CH_2OH$, —$CH(CH_3)$—OH, —$CH_2SH$, —$CH_2CONH_2$, —$CH_2CH_2CONH_2$, —$CH_2COOH$, or —$CH_2CH_2COOH$; Y is saturated or unsaturated $C_1$-$C_{30}$ alkyl; n is an integer in the range of about 2 to about 6; and m is 1 or 2;

(c) optionally an alkali metal halide salt; and (d) water;

wherein the surfactant is present in the high concentration, aqueous, liquid surfactant composition in a concentration of at least about 25% by weight, and the liquid-stabilizing agent is present in an amount of not more than about 10% by weight, on a total composition weight basis, and wherein the composition is non-liquid in the absence of the liquid stabilizing amount of the liquid stabilizing agent at an ambient temperature of about 20° C.

2. A liquid surfactant composition in accordance with claim 1 wherein the composition has a total solids content of at least about 30% by weight.

3. A liquid surfactant composition in accordance with claim 1 wherein the liquid-stabilizing agent is iminodisuccinic acid.

4. A liquid surfactant composition in accordance with claim 1 wherein the amphoteric surfactant is a betaine.

5. A liquid surfactant composition in accordance with claim 4 wherein the betaine has the general formula (X);

(X)

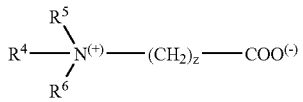

wherein $R^4$ is a linear alkyl having at least about 8 carbon atoms or $R^7CONH(CH_2)_k$, in which $R^7$ is a saturated or unsaturated alkyl group having at least 7 carbon atoms; k is 2 or 3; $R^5$ and $R^6$ are each independently $C_1$-$C_4$ alkyl; and z is 1, 2, or 3.

6. A liquid surfactant composition in accordance with claim 4 wherein the betaine is selected from the group consisting of lauramidopropyl betaine, myristamidopropyl betaine, palmitamidopropyl betaine, cocamidopropyl betaine, palm kernelamidopropyl betaine, babassuamidopropyl betaine, coco-betaine, lauryl betaine, myristyl betaine, cetyl betaine, cocamidopropyl hydroxysultaine, lauramidopropyl hydroxysultaine, palm kernelamidopropyl hydroxysultaine, babassuamidopropyl hydroxysultaine, myristamidopropyl hydroxysultaine, and a combination thereof.

7. A liquid surfactant composition in accordance with claim 4 having a total solids content of at least about 40% by weight.

8. A liquid surfactant composition in accordance with claim 4 wherein the liquid-stabilizing agent is iminodisuccinic acid.

* * * * *

UNITED STATES PATENT AND TRADEMARK OFFICE

CERTIFICATE OF CORRECTION

PATENT NO. : 7,256,164 B2
APPLICATION NO. : 10/491384
DATED : August 14, 2007
INVENTOR(S) : Richard Otterson et al.

It is certified that error appears in the above-identified patent and that said Letters Patent is hereby corrected as shown below:

Column 3, line 36, “comprises” should read --comprise--.

Column 3, line 37, “moiesties” should read --moieties--.

Column 6, in the paragraph after the structured formula (II), at about line 35.

“—$(CH)_2$-$PO_3H_2$” should read

-- —$(CH_2)_n$-$PO_3H_2$ --.

Signed and Sealed this

Twenty-seventh Day of November, 2007

JON W. DUDAS
*Director of the United States Patent and Trademark Office*